United States Patent [19]

Lathrop

[11] 4,286,340

[45] Sep. 1, 1981

[54] SWIM GOGGLES

[76] Inventor: Kim N. Lathrop, 1622 E. 56th Ave., Portland, Oreg. 97215

[21] Appl. No.: 101,819

[22] Filed: Dec. 10, 1979

[51] Int. Cl.[3] ..... A61F 9/02

[52] U.S. Cl. ..... 2/430; 2/452

[58] Field of Search ..... 2/428, 429, 430, 439, 2/440, 452

[56] References Cited

U.S. PATENT DOCUMENTS

| | | | |
|---|---|---|---|
| 1,742,412 | 1/1930 | O'Flanagan | 2/440 |
| 2,709,256 | 5/1955 | Baratelli | 2/428 X |
| 3,755,819 | 9/1973 | Douglas | 2/428 |
| 3,895,397 | 7/1975 | Douglas | 2/428 |
| 4,051,557 | 10/1977 | Bengtson et al. | 2/430 |

FOREIGN PATENT DOCUMENTS

| | | | |
|---|---|---|---|
| 346642 | 12/1904 | France | 2/439 |

*Primary Examiner*—Peter P. Nerbun

*Attorney, Agent, or Firm*—Robert W. Beach; Douglas E. Winters; Ward Brown

[57] ABSTRACT

An eyepiece has an upper edge fittable into the upper portion of the eye socket to deter displacement by water force and a lower portion overlying and generally conforming to the cheekbone to absorb diving shock and to limit inward movement. A cushion seal wider than the upper edge and partially bonded to it cushions the eyepiece fit. A head strap lug projects upwardly and rearwardly from the eyepiece so that the head strap connected to it urges the eyepiece upper edge up under the upper portion of the eye socket. The transversely curved front lens is inclined forwardly and downwardly to promote forward visibility during swimming and the side lens is substantially flat to improve peripheral vision and is faired into the curved front lens. A water-pocket recess is adapted to hold water for washing mist from the eyepiece internal surfaces, while preventing the water from coming into contact with the wearer's eyes during swimming, forms an inner pocket extending along the lower margin of the eyepiece which opens upwardly adjacent to the lens and has temple and nose end pockets.

9 Claims, 6 Drawing Figures

Fig. 1
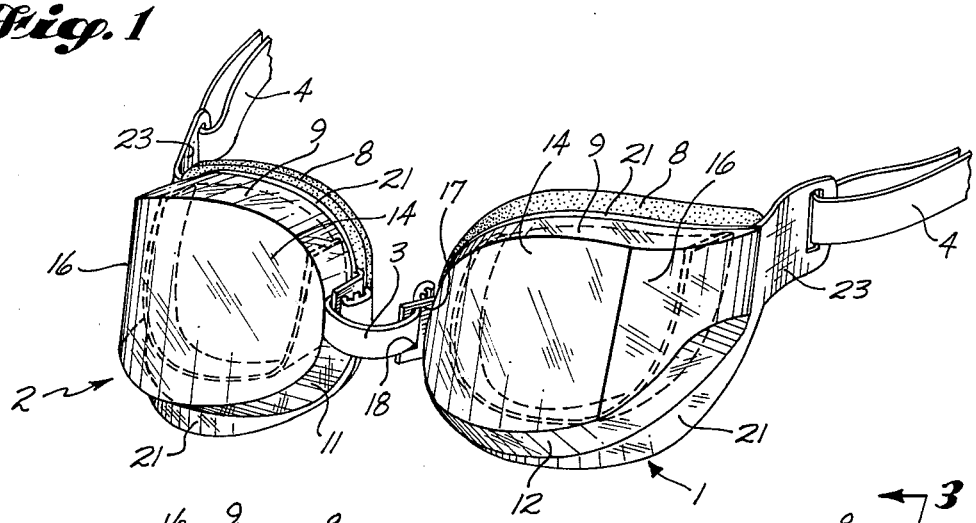
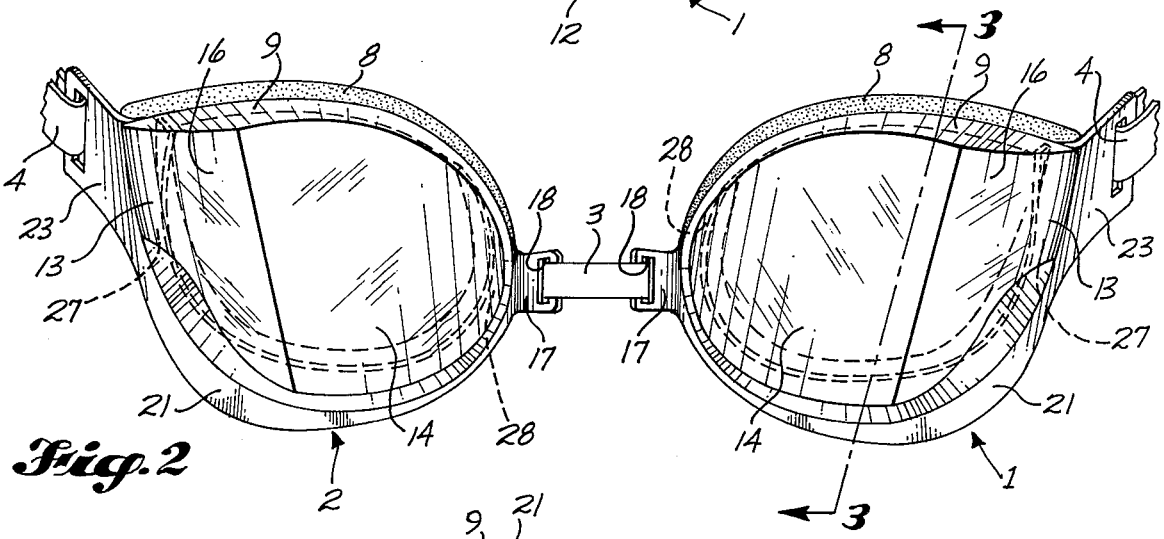
Fig. 2
Fig. 3
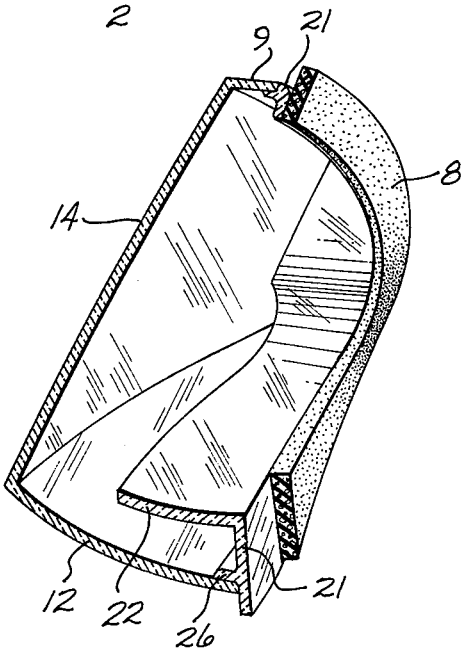

SWIM GOGGLES

BACKGROUND OF THE INVENTION

1. Field of the Invention

This invention relates generally to eye protectors and goggles, and more particularly to competition swim goggles.

2. Prior Art

Swim goggles were introduced to protect competitive swimmers' eyes from prolonged exposure to chlorinated water during training and competition. The eyepieces of the goggles disclosed in U.S. Pat. No. 2,709,256 to Baratelli fit into the eye socket or orbit, designated by Baratelli as the orbital brim, closely surrounding the eye. While this design provides a fairly hydrodynamically smooth transition between the brow and the goggles, it results in distorted vision and discomfort when sufficient pressure is applied to make each eyepiece seal watertight. The goggles of Bengtson et al., U.S. Pat. No. 4,051,557, improve eye comfort and eliminate distortion by having the eyepiece seal area moved out of the eye sockets and onto the bone structure surrounding the eye. However, the bone structure between individuals varies greatly, resulting in a loss of watertightness. Additionally, the increased water resistance causes the goggles to dislodge and partially fill with water during racing dives.

Douglas in U.S. Pat. No. 3,755,819 addresses the problem of fogging of swimmers' goggles which results from moisture of air trapped in each eyepiece cup being condensed when the lens is cooled by contact with water. Douglas discloses a channel recess area which contains water for clearing the fog while preventing contact of such water with the swimmer's eyes, but in so doing restricts the vision, particularly the forward vision of a surface swimmer.

SUMMARY OF THE INVENTION

It is an object of the present invention to provide swim goggles which give a comfortable watertight fit to individual swimmers without the expense of custom manufacturing.

A further object is to provide goggles which have such a watertight fit without distorting the swimmer's vision.

Another object is to provide swim goggles with means to wash the fog from the front of the goggles while keeping water out of the eyes even during competition flip turns and without obstructing the swimmer's forward vision.

An additional object is to provide swim goggles which are hydrodynamically streamlined to reduce water resistance and to prevent the goggles from being dislodged by a hard racing dive.

A still further object is to provide swim goggles with improved forward vision such that the swimmer may see the pool wall while swimming the crawl, breast stroke or butterfly, without lifting his head.

Finally, an object is to provide swim goggles with improved peripheral vision.

The above objects are accomplished by the swim goggles of the present invention which include a narrow rounded upper edge portion which fits into the upper portion of the eye socket, a wider lower edge portion which engages the outer side cheekbone at a location a substantial distance below its upper edge to absorb diving impact and to limit the inward movement of the eyepiece, and a head strap lug projecting upwardly and rearwardly from the outer end of each eyepiece cup so that the force applied to the goggles by the head strap draws the goggles back and upward under the eyebrows. A transparent lens portion includes a transversely curved front lens whose axis of curvature is inclined forwardly and downwardly and a flat side lens the forward portion of which fairs into the curved lens. The outer portion of the corresponding upper lens portion circumferential wall is wide enough to avoid objectionable concentration of pressure and narrow enough to fit into the upper portion of the eye socket to provide a hydraulically streamlined fit between the goggles and brow.

The eyepiece cups include interior waterpocket lips which are spaced inwardly from the rear portion of the eyepiece and form pockets or reservoirs at the temple and nose which will retain the water when the goggles are upside down. The lower portion of each lip is parallel to the lower portion of the eyepiece piece circumferential wall and projects toward the curved front lens, but terminates before reaching it, allowing the water to move from the reservoir over the interior of the front and side lenses when the swimmer tilts his head downward.

By both sloping the transversely curved lens forward and downward, and terminating the reservoir at the temple and nose, the forward vision of the swimmer is unobstructed and distortion minimized because a prone swimmer looks upward and forward, rather than straight forward.

BRIEF DESCRIPTION OF THE DRAWINGS

FIG. 1 is a perspective of the swim goggles of the present invention, parts broken away.

FIG. 2 is a front elevation of the swim goggles, parts broken away.

FIG. 3 is a section taken along line 3—3 of FIG. 2.

DETAILED DESCRIPTION

The preferred embodiment shown in FIG. 1 includes a left eyepiece 1 and a right eyepiece 2 which are connected by a flexible nose strap 3 adjustable in length to effect proper spacing of the eyepieces for the eyes of the particular swimmer. The goggles are held in place over the eyes by the adjustable elastic head strap 4.

Figure 4:
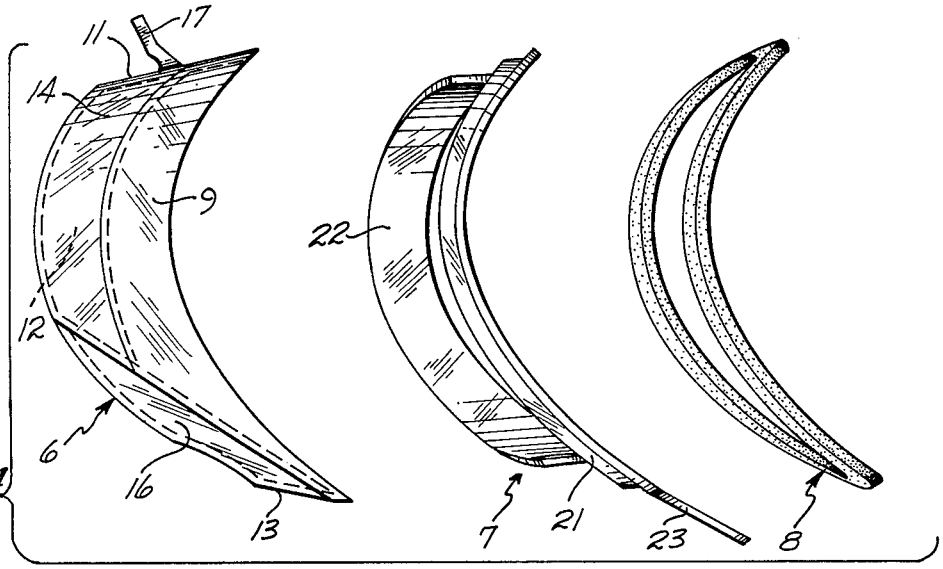
FIG. 4 is an exploded plan of the left eyepiece of the present invention.

As best seen in FIG. 4, each eyepiece includes lens portion 6, frame portion 7, and cushion seal 8. The lens portion 6 includes an upper circumferential wall portion 9, an interior circumferential wall portion 11 adjacent to the wearer's nose, a curved lower circumferential wall portion 12, an exterior circumferential wall portion 13 adjacent to the wearer's temple, transversely curved front lens 14 and flat side lens 16. The upper circumferential wall portion 9 is inclined slightly upward from the seal 8 to the smooth transition to the front lens 14 when the goggles are worn by a standing swimmer. The upper wall portion 9 is approximately $\frac{1}{8}$ to $\frac{1}{4}$ inch (0.32 to 0.64 cm) wide to reduce eye pressure and avoid concentrating the pressure exerted by head strap 4. When the goggles are worn the upper wall portion fits into the upper portion of the eye socket thereby presenting a hydrodynamically smooth transition between the brow and goggles. This feature not only reduces water resistance but also prevents the goggles from dislodging during hard racing dives. The lower circumferential wall portion 12 is slightly convex as best seen in FIG. 3. The interior circumferential wall portion 11 and the exterior circumferential wall portion 13 generally conform to the outline of the face.

The front lens 14 is curved transversely and is inclined forwardly and downwardly. The forward portion of each flat side lens 16 is faired into the outer portion of the corresponding transversely curved front lens. The forward and downward inclination of the front lens which begins below the brow greatly improves the forward vision of the swimmer. To appreciate the vision problem of a goggled swimmer, one must recognize the difference in straight ahead vision to a person walking and forward vision to a swimmer. The prior art addresses the problem of straight ahead vision and restricts, to some extent, a swimmer's visibility of things which he is approaching such as the end of a pool or another swimmer. The present invention allows a swimmer to see "forward" by looking upward rather than lifting his entire head and looking forward, which would interfere with his swimming stroke. The flat side lens which is inclined rearwardly and outwardly from the front lens enables good peripheral vision. In each instance the line of sight is generally perpendicular to the lens, which minimizes distortion.

Figure 5:
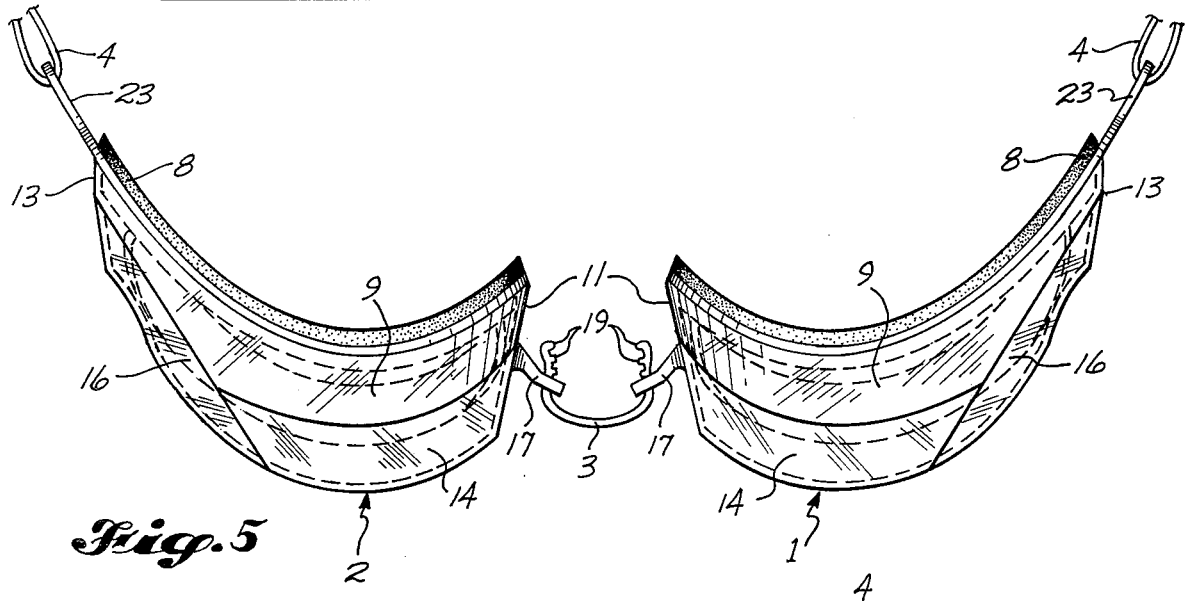
FIG. 5 is a plan of the swim goggles, parts broken away.

The lens portion 6 additionally includes lug 17 through the slot 18 of which adjustable nose strap 3 is threaded. The nose strap is formed with a plurality of stops 19, see FIG. 5, projecting outwardly from its inner surface and spaced longitudinally of the strap. These stops are of such size and rigidity as normally to prevent movement of the nose strap through lug slots 18, but they are of such size and flexibility as to pass through the slots when subjected to a strong longitudinal pull to permit adjusting the length of the nose strap.

The lens portion 6 is bonded to the frame portion 7 creating a watertight seal. The frame portion 7 includes an exterior sealing lip 21, an interior water-pocket lip 22, and head strap lug 23. As best shown in FIG. 3, the upper portion of exterior sealing lip 21 is rounded and mortised flush with the upper circumferential wall portion 9 of the lens portion 6 to form an upper flange and a comfortable seal with the soft tissue of the upper portion of the eye socket. The exterior sealing lip 21 of frame portion 7 follows the interior contour of the eye socket under the eyebrow to the temple where it progresses out of the eye socket, becomes wider, and conforms to the outer side of the essentially vertical cheekbone at a location a substantial distance below its upper edge as indicated by the wide flat shape of the lower portion of the sealing lip 21 as shown in FIG. 3. The exterior sealing lip tapers to the nose area and completes the ovaloid circuit. The wider bottom portion of the lip flange 21 shown in FIG. 3, which overlies the outer side of the cheekbone, absorbs the shock of racing dives and keeps the upper margin of the frame portion which is within the eye socket from being pulled back so as to break the seal of the goggles and cause discomfort and visual distortion.

As best shown in FIG. 3, the frame portion 7 includes a lower bonding lip 26 which aligns and is bonded to the lens portion 6. The lower bonding lip 26 terminates before reaching the interior circumferential wall portion 11 and terminates at the exterior circumferential wall portion 13. In addition to being bonded to the lower bonding lip, the circumferential wall of the lens portion 6 is bonded to the frame portion 7 substantially perpendicularly around its entire circumference, forming a watertight seal.

As best shown in FIG. 3, the interior lip 22 of the frame portion 7 projects forward from the exterior sealing lip 21 towards the front lens 14, but terminates before reaching the lens, forming an inner cantilevered shelf generally parallel to the lower circumferential wall 12. The interior lip continues to generally follow the lower circumferential wall as it progresses toward the temple and nose areas where it is bonded to the interior of the lens portion 6 at the side lens 16, interior circumferential wall portion 11, and upper circumferential wall portion 9 forming exterior and interior reservoirs or end pockets, 27 and 28, respectively. As seen in FIG. 2, the interior lip 22 does not obstruct the swimmer's forward vision. Before donning the goggles, the swimmer holds the goggles upside down and partially fills one of the reservoirs in each of the eyepieces. In this manner sufficient water is trapped in the eyepiece to permit washing the fog off the front and side lenses by tipping the head down. The quantity trapped will not overflow the reservoirs and enter the swimmer's eyes during a flip turn or when the swimmer turns his head to the side.

Figure 6:
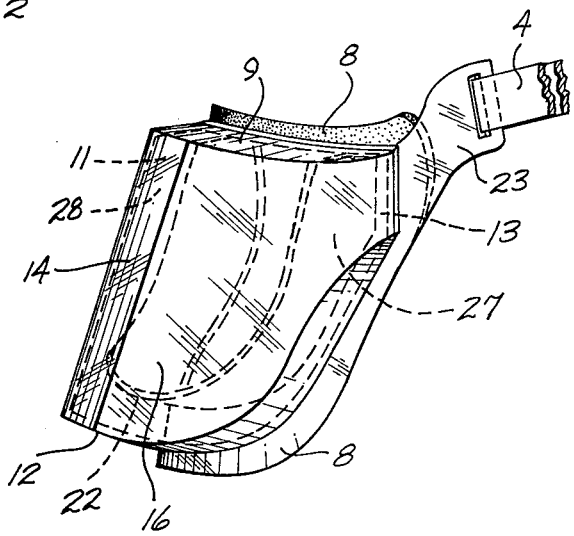
FIG. 6 is a side elevation of the swim goggles, parts broken away.

The head strap lug 23 (FIG. 6) projects upward and rearward from each eyepiece cup so that the force applied to the goggles by the head strap 4 draws the goggles back and upward under the eyebrow. This feature of the invention permits a watertight seal and allows the upper rims of the eyepiece cups to be placed within the upper portions of the eye sockets, thereby reducing water resistance and preventing dislodgement of the goggles even during hard racing dives without the discomfort and distortion of vision which occurs if the force is applied straight back as in the prior art.

Finally, the seal 8 is attached to the frame portion 7 by a watertight bond. As shown in FIG. 3, the seal is the same width as the frame portion except for the portion which is adjacent to the upper frame portion which fits into the eye socket. This portion of the seal includes an unbonded portion which conforms between the rounded upper frame portion and lens portion joint, and the flesh and bone of the eye socket. The unbonded portion of the seal is wide enough to be received between the eyepiece upper circumferential wall portion and the eye socket to cushion contact with the eye socket and thus prevent irritation.

The lens portion and frame portion are preferably formed of suitable clear transparent plastic material, such as a polycarbonate or acrylic, which is strong and stiff but slightly flexible, and will not shatter if subjected to a hard blow. While the front lens 14, side lens 16 and upper circumferential wall portion 9 must be transparent, the remainder of the lens portion 6 and the frame portion 7 may optionally be made opaque or translucent. The seal 8 is preferably a formed thermoplastic resilient foam such as polyurethane.

I claim:

1. In swim goggles including two eyepiece cups, nose strap means for connecting inner ends of such cups and head strap means for connecting outer ends of such cups and extending around the head of a wearer, the improvement comprising each eyepiece cup including a frame portion having an upper margin fittable into the upper portion of an eye socket of the wearer so that the eyepiece cup presents a hydrodynamically smooth transition between the wearer's eyebrow and the goggles, said eyepiece cup frame portion upper margin including a flange and a generally rounded transition portion between said flange and the remainder of the eyepiece cup to minimize discomfort to the wearer, and each eyepiece cup frame portion having a lower margin which generally conforms with the outer side of the cheekbone of the wearer at a location a substantial distance below its upper edge.

2. In swim goggles including two eyepiece cups, nose strap means for connecting inner ends of such cups, head strap means for connecting outer ends of such cups and extending around the head of a wearer and a cushion seal bonded to the circumference of each eyepiece cup, the improvement comprising such eyepiece cup including a frame portion having a lower margin which generally conforms with the cheekbone of the wearer and an upper margin fittable into the upper portion of an eye socket of the wearer, said eyepiece cup frame portion upper margin including a flange and a generally rounded transition portion between said flange and the remainder of the eyepiece cup to minimize discomfort to the wearer, the cushion seal being wider than said eyepiece cup frame portion upper margin and having a portion projecting upward beyond said upper margin to be folded over said rounded transition portion by contact with the eye socket of the wearer.

3. In the goggles defined in claim 2, a head strap lug projecting upwardly and rearwardly from the temple portion of the frame portion to which the head strap means is connected for drawing the goggles back and up to lodge the eyepiece cup frame portion upper margin in the upper portion of the wearer's eye socket.

4. In swim goggles including two eyepiece cups, nose strap means for connecting inner ends of such cups and head strap means for connecting outer ends of such cups and extending around the head of a wearer, the improvement comprising each eyepiece cup including a transversely curved front lens, and spacing means mounting each of said front lenses for maintaining the uppermost parts of said front lenses spaced from the face of the wearer a distance less than the distance the lowermost parts of said front lenses are spaced from the face of the wearer so that each of said front lenses is inclined rearwardly substantially from the lowermost part of such front lens upward to the uppermost part of such front lens for minimizing forward vision distortion during swimming.

5. In the goggles defined in claim 4, the upper margin of each eyepiece cup being fittable into the socket immediately below the wearer's eyebrow so that the eyepiece cup presents a hydrodynamically smooth transition between the wearer's eyebrow and the goggles.

6. In the goggles defined in claim 4, each eyepiece cup including a substantially flat rearwardly and outwardly inclined side lens having its forward portion faired into the outer portion of the corresponding front lens for minimizing peripheral vision distortion.

7. In swim goggles including two eyepiece cups each having a forward wall, a rear sealing lip and a lower circumferential wall bridging between the forward wall and the rear sealing lip, nose strap means for connecting inner ends of such cups and head strap means for connecting outer ends of such cups and extending around the head of a wearer, the improvement comprising an interior lip projecting forward from and joined to the rear sealing lip, constituting a cantilevered shelf substantially parallel to and spaced above the lower circumferential wall, terminating in spaced relationship to the forward wall and having upper ends joined to the eyepiece cup at spaced locations above the lower circumferential wall, thereby forming a forwardly-opening recess between said interior lip and the lower circumferential wall including two spaced apart end pockets, said recess being adapted to hold water for washing the eyepiece cup internal surfaces while deterring the water from coming into contact with the wearer's eye covered by such cup during swimming including flip turns and permitting unobstructed forward vision.

8. In swim goggles including two eyepiece cups each having a forward wall, a rear sealing lip and a lower circumferential wall bridging between the forward wall and the rear sealing lip, nose strap means for connecting inner ends of such cups, head strap means for connecting outer ends of such cups and extending around the head of a wearer and a cushion seal bonded to the circumference of each eyepiece cup, the improvement comprising an interior lip projecting forward from and joined to the rear sealing lip, constituting a cantilevered shelf substantially parallel to and spaced above the lower circumferential wall, terminating in spaced relationship to the forward wall and having upper ends joined to the eyepiece cup at spaced locations above the lower circumferential wall, thereby forming a forwardly-opening recess between said interior lip and the lower circumferential wall including two spaced apart end pockets, said recess being adapted to hold water for washing the eyepiece cup internal surfaces while deterring the water from coming into contact with the wearer's eye covered by such cup during swimming including flip turns and permitting unobstructed forward vision; a frame portion having a lower margin which generally conforms with the outer side of the cheekbone of the wearer at a location a substantial distance below its upper edge and an upper margin fittable into the upper portion of an eye socket of the wearer immediately below the wearer's eyebrow so that the eyepiece cup presents a hydrodynamically smooth transition between the wearer's eyebrow and the goggles, said upper margin including a flange and a generally rounded transition portion between said flange and the remainder of the eyepiece cup to minimize discomfort to the wearer; the cushion seal being wider than said eyepiece cup frame portion upper margin and having a portion projecting upward beyond said upper margin to be folded over said rounded transition portion by contact with the eye socket of the wearer; a head strap lug projecting upwardly and rearwardly from the temple portion of said frame portion to which the head strap means is connected for drawing the goggles back and up to lodge said eyepiece cup frame portion upper margin in the upper portion of the wearer's eye socket; a transversely curved front lens; spacing means mounting said front lens for maintaining the uppermost part of said front lens spaced from the face of the wearer a distance less than the distance the lowermost part of said front lens is spaced from the face of the wearer so that said front lens is inclined rearwardly substantially from the lowermost part of said front lens upward to the uppermost part of said front lens for minimizing forward vision distortion during swimming; and a substantially flat rearwardly and outwardly inclined side lens having its forward portion faired into the outer portion of said front lens for minimizing peripheral vision distortion.

9. In swim goggles including two eyepiece cups, nose strap means for connecting inner ends of such cups and head strap means for connecting outer ends of such cups and extending around the head of a wearer, the improvement comprising each eyepiece cup including a frame portion having a lower margin which generally conforms with the cheekbone of the wearer, an upper margin fittable into the upper portion of an eye socket of the wearer and a head strap lug projecting upwardly and rearwardly from the temple portion of said frame portion to which the head strap means is connected for drawing the goggles back and up to lodge said eyepiece cup frame portion upper margin in the upper portion of the wearer's eye socket, said eye piece frame portion upper margin including a flange and a generally rounded transition portion between said flange and the remainder of the eyepiece cup to minimize discomfort to the wearer.

* * * * *

UNITED STATES PATENT AND TRADEMARK OFFICE

CERTIFICATE OF CORRECTION

PATENT NO. : 4,286,340
DATED : September 1, 1981
INVENTOR(S) : Kim N. Lathrop

It is certified that error appears in the above-identified patent and that said Letters Patent are hereby corrected as shown below:

Title page, [76] Inventor, after "1622" insert ---S.---.

Column 5, line 17, cancel "such" and insert ---each---.

Signed and Sealed this

*Seventeenth* Day of *November 1981*

[SEAL]

*Attest:*

GERALD J. MOSSINGHOFF

*Attesting Officer* *Commissioner of Patents and Trademarks*